US010651549B2

(12) United States Patent
Li et al.

(10) Patent No.: US 10,651,549 B2
(45) Date of Patent: May 12, 2020

(54) MICROWAVE DEVICE

(71) Applicant: InnoLux Corporation, Miao-Li County (TW)

(72) Inventors: I-Yin Li, Miao-Li County (TW); Chin-Lung Ting, Miao-Li County (TW); Chia-Chi Ho, Miao-Li County (TW); Yi-Hung Lin, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 129 days.

(21) Appl. No.: 16/026,171

(22) Filed: Jul. 3, 2018

(65) Prior Publication Data

US 2019/0013574 A1 Jan. 10, 2019

Related U.S. Application Data

(60) Provisional application No. 62/528,999, filed on Jul. 6, 2017.

(30) Foreign Application Priority Data

Jan. 30, 2018 (CN) ..... 2018 1 0090981
Jun. 20, 2018 (CN) ..... 2018 1 0637523

(51) Int. Cl.
*H01Q 1/40* (2006.01)
*H01Q 3/44* (2006.01)
*H01Q 1/36* (2006.01)

(52) U.S. Cl.
CPC ..... *H01Q 1/40* (2013.01); *H01Q 1/364* (2013.01); *H01Q 3/44* (2013.01)

(58) Field of Classification Search
CPC ..... H01Q 1/364; H01Q 1/36; H01Q 1/40; H01Q 3/44; H01Q 7/00; H01Q 9/16;
(Continued)

(56) References Cited

U.S. PATENT DOCUMENTS 5,087,920 A * 2/1992 Tsurumaru ..... H01Q 21/0081 343/700 MS
6,320,543 B1 * 11/2001 Ohata ..... H01Q 9/0407 343/700 MS (Continued)

FOREIGN PATENT DOCUMENTS

CN 101930133 A 12/2010
CN 104317113 A 1/2015

(Continued)

OTHER PUBLICATIONS

Chinese language office action dated Nov. 28, 2019, issued in application No. CN 201810637523.5.

*Primary Examiner* — Tho G Phan
(74) *Attorney, Agent, or Firm* — McClure, Qualey & Rodack, LLP

(57) ABSTRACT

A microwave device includes a first substrate having a first surface, a first metal layer, a second substrate having a second surface corresponding to the first substrate, a second metal layer, a sealing element, a modulation material, and a fill material. The first metal layer is disposed on the first surface, and the first metal layer includes openings. The second metal layer is disposed on the second surface. The second metal layer includes electrodes corresponding to the openings. The sealing element is located between the first substrate and the second substrate. An active zone is formed by a space between the sealing element, the first substrate, and the second substrate. The modulation material is filled within the active area. The fill material is disposed in the active area. The thickness of the fill material is greater than 0.3 μm, and less than the thickness of the sealing element.

20 Claims, 11 Drawing Sheets

(58) Field of Classification Search
CPC ... B32B 15/09; B32B 15/20; B32B 2307/412; B32B 2457/20; B32B 27/08; B32B 27/18; B32B 27/36; B32B 3/30; C23C 18/1608; C23C 18/161; C23C 18/1641; C23C 18/1651; C23C 18/30; C23C 18/32; C23C 18/38; C23F 1/02; H01L 23/145; H01L 23/498; H01L 23/52; H01L 25/0753; H01L 27/156; H01L 33/62
See application file for complete search history.

(56) References Cited

U.S. PATENT DOCUMENTS

| | | | | |
|---|---|---|---|---|
| 7,903,040 | B2 * | 3/2011 | Gevorgian | H01P 1/2005 343/767 |
| 8,634,050 | B2 | 1/2014 | Yamazaki et al. | |
| 8,988,370 | B2 | 3/2015 | Shi et al. | |
| 9,553,364 | B2 * | 1/2017 | Williams | H01Q 3/446 |
| 10,461,412 | B2 * | 10/2019 | Li | H01Q 3/44 |
| 2018/0205148 | A1 * | 7/2018 | Li | H01Q 9/27 |
| 2019/0103644 | A1 | 4/2019 | Jakoby et al. | |

FOREIGN PATENT DOCUMENTS

| | | | |
|---|---|---|---|
| CN | 105308789 | A | 2/2016 |
| CN | 106353906 | A | 1/2017 |

* cited by examiner

MICROWAVE DEVICE

CROSS-REFERENCE TO RELATED APPLICATIONS

This application claims the benefit of U.S. Provisional Application No. 62/528,999 filed on Jul. 6, 2017, the entirety of which is incorporated by reference herein. This application claims priority of China Patent Application No. 201810090981.1 filed on Jan. 30, 2018, the entirety of which is incorporated by reference herein. This application claims priority of China Patent Application No. 201810637523.5 filed on Jun. 20, 2018, the entirety of which is incorporated by reference herein.

BACKGROUND

Field of the Disclosure

The present disclosure relates to a microwave device, and in particular to a microwave device with less modulation material.

Description of the Related Art

Liquid-crystal antenna units are utilized in microwave devices. The rotation of liquid-crystal units can be controlled by an electric field, and thus the dielectric constants of the liquid-crystal antenna units can be changed according to the characteristics of the double dielectric constants of the liquid-crystal units. Moreover, the arrangement of the liquid-crystal units is controlled by electrical signals so as to change the dielectric constant of each unit of the microwave systems. Therefore, the phases or amplitudes of the microwave signals of the microwave device can be controlled. The transmitting directions of the wavefronts emitted by the microwave device are defined as the directions of maximum intensity of radiation pattern of the microwave device.

By controlling the radiation directions of the microwave device, the strongest microwave signals can be searched for. The receiving or radiation directions can be adjusted according to the signal source, and thus the communication quality is enhanced. The signal source can be a satellite in space, a base station on the ground, or another signal source.

Wireless communication via microwave devices can be used in many different kinds of vehicles, such as airplanes, yachts, ships, trains, cars, and motorcycles, or applied to the internet of things (IoT), autopilot, or autonomous vehicles. Electronic microwave devices have many advantages over conventional mechanical antennas, such as being flat, lightweight, and thin, and having a short response time.

Although existing microwave devices have been generally adequate for their intended purposes, they have not been entirely satisfactory in all respects. Consequently, it is desirable to provide a solution for improving microwave devices.

BRIEF SUMMARY

The present disclosure provides a microwave device including a first substrate, a first metal layer, a second substrate, a second metal layer, a sealing element, a modulation material, at least one fill material. The first substrate has a first surface. The first metal layer is disposed on the first surface, and the first metal layer includes a plurality of openings. The second substrate has a second surface corresponding to the first substrate, and the second surface is adjacent to the first surface. The second metal layer is disposed on the second surface. The second metal layer includes a plurality of electrodes corresponding to the openings. The sealing element is located between the first substrate and the second substrate. An active zone is formed by a space between the sealing element, the first substrate, and the second substrate. The modulation material is filled into the active zone. The fill material is disposed in the active zone. The thickness of the fill material is greater than 0.3 μm and less than the height of the sealing element. The ratio of the projection area of the fill material on the first surface to the projection area of the active zone on the first surface is in a range from about 0.02 to 0.83.

The present disclosure provides a microwave device including a first substrate, a first metal layer, a second substrate, a second metal layer, a sealing element, a modulation material, and at least one fill material. The first substrate has a first surface. The first metal layer is disposed on the first surface and has a plurality of openings. The second substrate has a second surface corresponding to the first substrate, and the second surface is adjacent to the first surface. The second metal layer is disposed on the second surface. The second metal layer includes a plurality of electrodes corresponding to the openings. At least one modulation zone is located between the electrodes and the first metal layer in the stacking direction. The modulation zone has a first spacing distance d. The sealing element is located between the first substrate and the second substrate. An active zone is formed by a space between the sealing element, the first substrate, and the second substrate. The modulation material is filled into the active zone. The fill material is disposed in the active zone. The thickness of the fill material is greater than 0.3 μm, and less than the height of the sealing element. The projection area of the active zone on the first surface is A, and the volume of the fill material divided by (A*d) is in a range from 0.02 to 0.86.

The present disclosure provides a microwave device including a first substrate, a first metal layer, a second substrate, a second metal layer, a sealing element, a modulation material, and at least one fill material. The first substrate has a first surface. The first metal layer is disposed on the first surface. The first metal layer further includes a plurality of openings. The second substrate has a second surface corresponding to the first substrate. The second metal layer is disposed on the second surface. The second metal layer includes a plurality of electrodes corresponding to the openings. There is at least one modulation zone between the electrodes and the first metal layer in the stacking direction. The sealing element is located between the first substrate and the second substrate. An active zone is formed by a space between the sealing element, the first substrate, and the second substrate. The modulation material is filled into the active zone. The fill material is located between the first substrate and the second substrate. The active zone has an area A, the modulation zone has a spacing distance d. The volume of the modulation material divided by (A*d) is in a range from 0.14 to 0.98.

BRIEF DESCRIPTION OF THE DRAWINGS

The disclosure can be more fully understood by reading the subsequent detailed description and examples with references made to the accompanying drawings, wherein.

DETAILED DESCRIPTION

Figure 1:
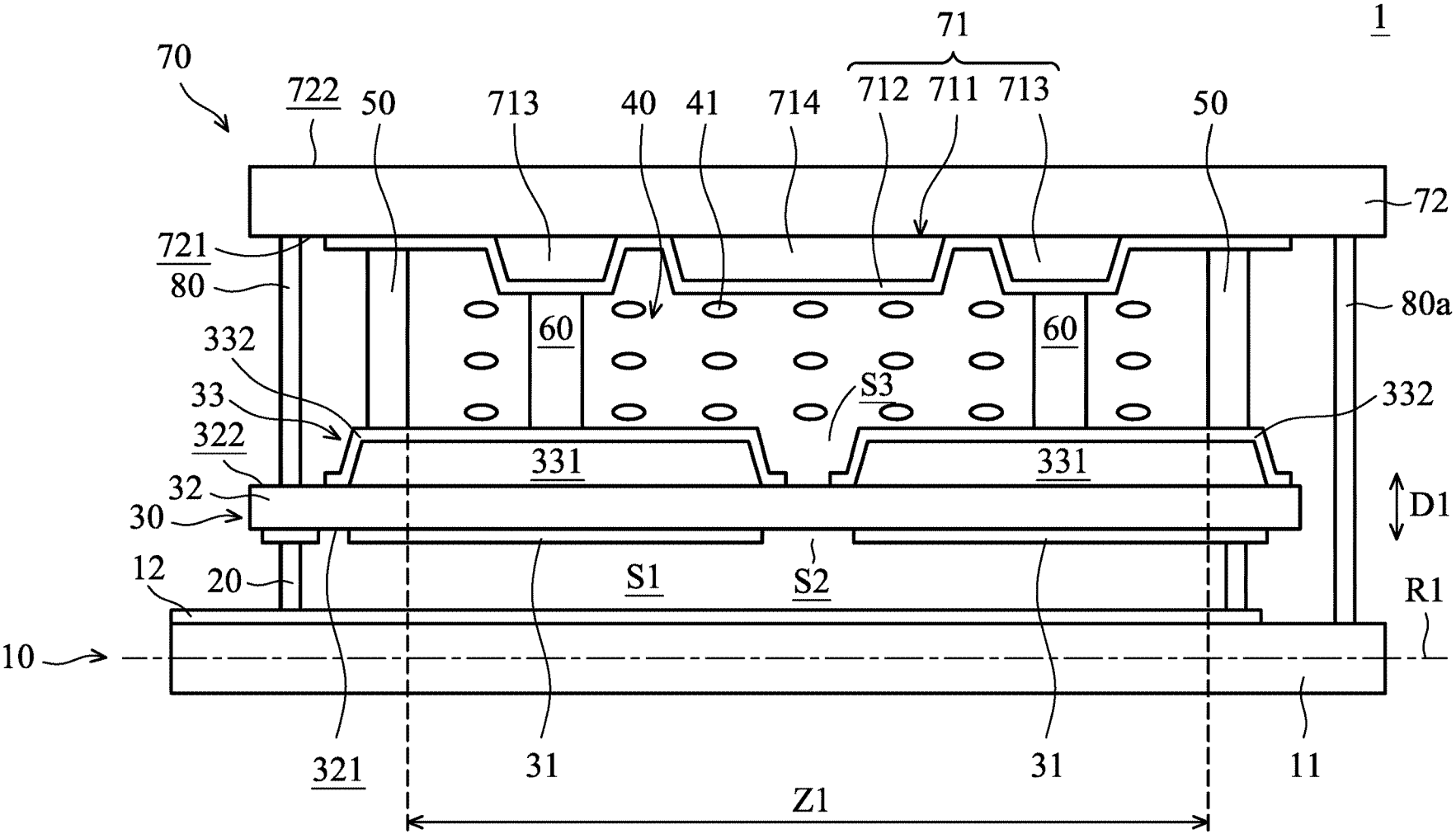
FIG. 1 is a cross-sectional view of a microwave device in accordance with a first embodiment of the disclosure.

The following disclosure provides many different embodiments, or examples, for implementing different features of the present disclosure. Specific examples of components and arrangements are described below to simplify the present disclosure. For example, the formation of a first feature over or on a second feature in the description that follows may include embodiments in which the first and second features are formed in direct contact, and may also include embodiments in which additional features may be formed between the first and second features, such that the first and second features may not be in direct contact.

The words, such as "first" or "second", in the specification are for the purpose of clarity of description only, and are not relative to the claims or meant to limit the scope of the claims. In addition, terms such as "first feature" and "second feature" do not indicate the same or different features.

Spatially relative terms, such as upper and lower, may be used herein for ease of description to describe one element or feature's relationship to another element(s) or feature(s) as illustrated in the figures. The spatially relative terms are intended to encompass different orientations of the device in use or operation in addition to the orientation depicted in the figures. For clearly, the first feature disposed on or under the second feature of the disclosure means the first feature disposed on or under the second feature of the disclosure along the stacking direction in figures. The shape, size, thickness, and slope in the drawings may not be drawn to scale or simplified for clarity of discussion; rather, these drawings are merely intended for illustration.

FIG. 1 is a cross-sectional view of a microwave device 1 in accordance with a first embodiment of the disclosure. The microwave device 1 can be a liquid-crystal antenna device. The microwave device 1 is configured to emit or receive microwave signals. The frequency range of microwave signals is in a range from about 300 MHz to 300 GHz. In another embodiment, the frequency range of the microwave signals is in a range from about 10 GHz to 40 GHz.

The microwave device 1 includes a radiator 10, support structures 20, a substrate 32, a first radiation-signal layer 33, a modulation material 40, a sealing element 50, spacing structures 60, a second radiation-signal layer 71 and a substrate 72. The radiator 10 extends along a reference plane R1. The support structure 20 is disposed on the radiator 10. The substrate 32 is disposed on the support structure 20. The substrate 32 is parallel to the radiator 10.

There is a microwave-transmission layer S1 between the radiator 10 and the substrate 32, and configured for transmitting microwave signals. In some embodiments, the microwave-transmission layer S1 is gas, substantially vacuum, liquid, heat-insulating material, other suitable mediums for microwave-transmission layer, or a combination thereof.

The radiator 10 includes a substrate 11 and a transmission layer 12. The substrate 11 extends along the reference plane R1. The substrate 11 may be made by solid materials. In some embodiments, the materials of the substrate 11 may be glass materials, metal materials, plastic materials or other insulation materials, but it is not limited thereto.

The transmission layer 12 is disposed on the substrate 11. The transmission layer 12 may be a thin-film structure. The transmission layer 12 may be made of metal materials, conductive materials, other suitable materials for transmission layer, or a combination thereof. In some embodiments, the transmission layer 12 covers over half or one-third area of the substrate 11. In some embodiments, the transmission layer 12 covers over 4/5 area of the substrate 11. In some embodiments, the transmission layer 12 is grounding. It should be noted that, if the substrate 11 is made of metal, the transmission layer 12 and the substrate 11 are formed as single piece.

The support structure 20 is located between the radiator 10 and the substrate 32. In this embodiment, the support structure 20 is disposed on the transmission layer 12. In other embodiments, the support structure 20 is disposed on the substrate 11.

The support structure 20 extends along the stacking direction D1 perpendicular to the reference plane R1. In other words, the stacking direction D1 is a normal direction of the substrate 11. In some embodiments, the support structure 20 includes metal materials, insulation materials, rigid materials, or rigid-insulation materials.

The support structure 20 is configured to separate the radiator 10 and the substrate 32, and maintain the distance between the radiator 10 and the substrate 32, so as to form the microwave-transmission layer S1 between the radiator 10 and the substrate 32. In some embodiments, the support structure 20, the transmission layer 12 and the substrate 11 are formed as a single piece.

The substrate 32 and a first radiation-signal layer 33 form a radiator 30 disposed on the support structure 20. The radiator 30 extends in a plane parallel to a reference plane R1. In other words, the radiator 30 is parallel to the radiator 10, and separated from the radiator 10. In this disclosure, it should be noted that the radiator is a structure that includes a metal layer and a substrate, and has the function of transmitting or receiving radiation signals, but it is not limited thereto.

The microwave device 1 further includes a transmission layer 31. The transmission layer 31 is disposed on the lower surface 321 of the substrate 32. The transmission layer 31 may be a thin-film structure covering over 2/3 of the area of the lower surface 321 of the substrate 32. The transmission layer 31 may be made of metal materials, conductive materials, other suitable materials for transmission layer, or a combination thereof.

Moreover, the transmission layer 31 has an opening S2. In some embodiments, the transmission layer 31 has many openings S2. In some embodiments, the transmission layer 31 can be omitted. The radiation signal can be transmitted from the transmission layer 12 to the first radiation-signal layer 33 via the microwave-transmission layer S1 and the substrate 32.

The substrate 32 is parallel to the substrate 11, and separated from the substrate 11. In some embodiments, the materials of the substrate 32 may be glass materials, polyimide (PI), liquid-crystal polymer, or other insulation materials, but it is not limited thereto. The materials of the substrate 32 may be other suitable materials for substrate.

The first radiation-signal layer 33 is disposed on a first surface 322 of the substrate 32 opposite to the lower surface 321. The first radiation-signal layer 33 may be a thin-film structure. The first radiation-signal layer 33 includes an opening S3 located over the opening S2 of the transmission layer 31. In some embodiments, the first radiation-signal layer 33 includes many openings S3.

The modulation material 40 is located between the substrate 32 and the substrate 72. At least one portion of the modulation material 40 is located over the opening S3, and is filled into the opening S3. In some embodiments, the modulation material 40 may be liquid-crystal materials that include many modulation molecules 41. In this embodiment, the modulation molecules 41 are liquid-crystal molecules.

The sealing element 50 is disposed between the substrate 32 and the substrate 72. An active zone Z1 is formed by a space between the sealing element 50, the substrate 32, and the substrate 72, and the modulation material 40 is filled into the active zone Z1.

The sealing element 50 may be a sealed structure, such as ring-like structure or polygon structure. In some embodiments, the sealing element 50 may include insulation materials or conductive materials. The sealing element 50 may include plastic or plastic-like materials. When the modulation material 40 is a liquid-crystal material, the sealing element 50 surrounds the liquid-crystal materials to prevent the liquid-crystal materials from flowing out of the microwave device 1.

The plastic or plastic-like materials may be made of single material or composite materials, such as polyethylene terephthalate (PET), polyethylene (PE), polyethersulfone (PES), Polycarbonate (PC), polymethylmethacrylate (PMMA), or glass, but they are not limited thereto.

Figure 2:
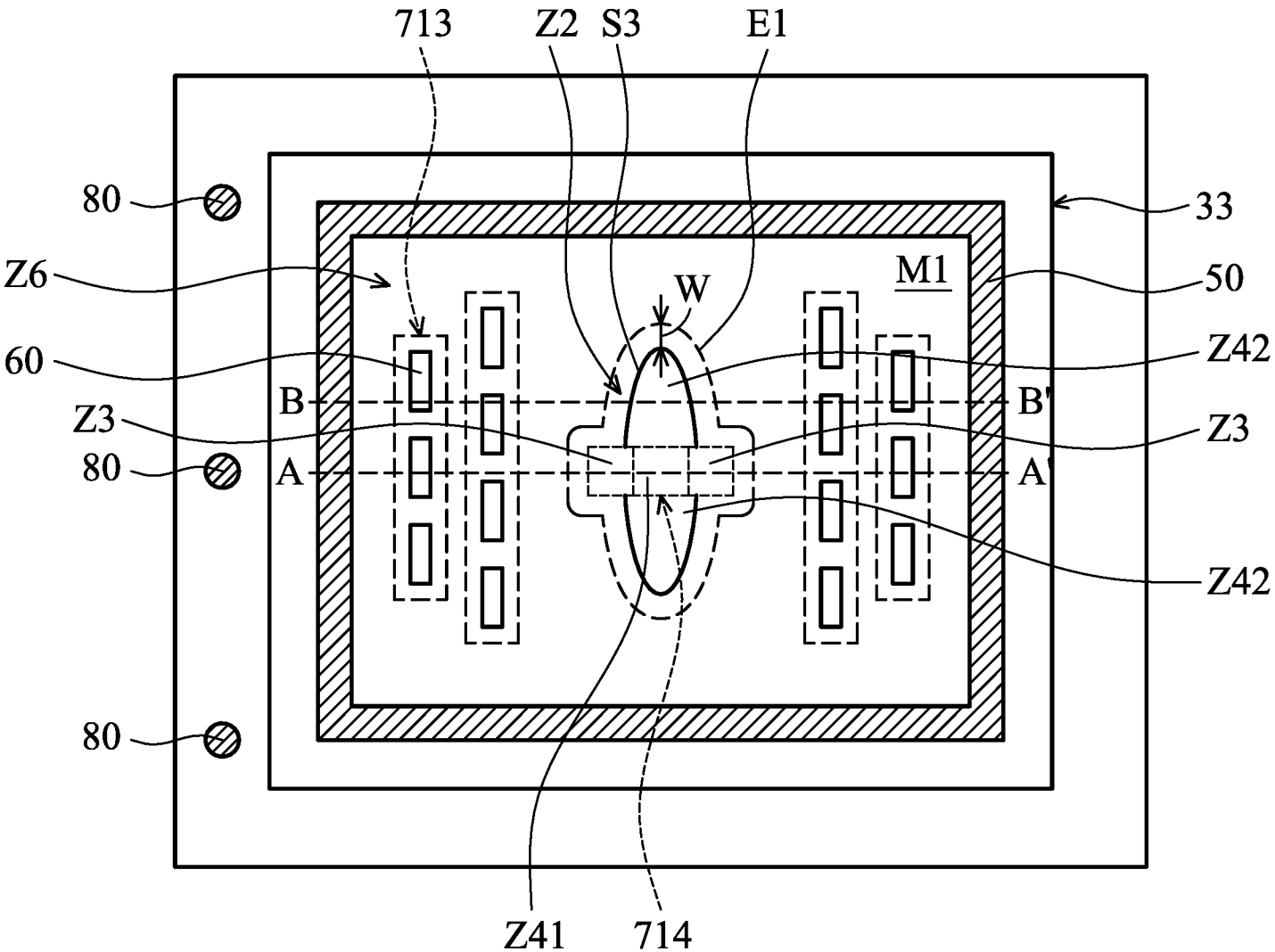
FIG. 2 is a schematic view of a microwave device in accordance with a first embodiment of the disclosure.

The spacing structure 60 is located between the substrate 32 and the substrate 72, and extends along the stacking direction D1. The spacing structure 60 is located in a zone surrounding by the sealing element 50, and is in contact with the modulation material 40. In some embodiments, the spacing structure 60 may be a ring-like structure. In other embodiments, the spacing structure 60 may be a columnar structure (as shown in FIG. 2).

The spacing structure 60 is configured to strengthen the structure of the microwave device 1, and to maintain the distance between the substrate 32 and the substrate 72. The spacing structure 60 may be disposed on the substrate 32, and it may be disposed under the substrate 72. In some embodiments, the spacing structure 60 may be disposed on the first radiation-signal layer 33, and it may be disposed under the second radiation-signal layer 71.

The spacing structure 60 may include insulation materials or conductive materials. In some embodiments, the spacing structure 60 may include copper, silver, gold, or alloys thereof. In some embodiments, the spacing structure 60 may include plastic or plastic-like materials. The plastic or plastic-like materials may be made of a single material or composite materials, such as polyethylene terephthalate (PET), polyethylene (PE), polyethersulfone (PES), Polycarbonate (PC), polymethylmethacrylate (PMMA), or glass, but they are not limited thereto. The spacing structure 60 may be made of adhesive materials.

The substrate 72 is disposed on the modulation material 40 and the support structure 80. The substrate 72 extends in a plane parallel to the reference plane R1. In other words, the substrate 72 is parallel to the substrate 32, and separated from the substrate 32.

The substrate 72 has a second surface 721 and a third surface 722 opposite to the second surface 721. The second surface 721 faces the radiator 30 (or the substrate 32). In other words, the second surface 721 is adjacent to the first surface 322. In some embodiments, the materials of the substrate 72 may be glass materials, polyimide (PI), liquid-crystal polymer, or other insulation materials, but it is not limited thereto.

The microwave device 1 may include a second radiation-signal layer 71. The second radiation-signal layer 71 may be a thin-film structure disposed on the second surface 721 of the substrate 72. A portion of the second radiation-signal layer 71 extends out of the sealing element 50 (indicates that a portion of the second radiation-signal layer 71 extends out of the active zone Z1). The microwave device 1 emits microwave signals by the second radiation-signal layer 71. The second radiation-signal layer 71 and the substrate 72 are formed as a radiator 70.

In this embodiment, the microwave signals enter the microwave device 1 by the waveguide structure formed by the microwave-transmission layer S1 between the transmission layer 12 and the transmission layer 31. The microwave signals are transmitted in the microwave-transmission layer S1 between the transmission layer 12 and the transmission layer 31, and are coupled with the second radiation-signal layer 71 via the opening S2, the opening S3 and the modulation material 40. The microwave signals in the modulation material 40 can be emitted from the second radiation-signal layer 71 to the outside of the microwave device 1 or not, which is determined by the equivalent circuit formed by the first radiation-signal layer 33, the second radiation-signal layer 71 and the modulation material 40.

The modulation-control signals can be fed into the microwave device 1 via the second radiation-signal layer 71. Since the modulation structure 40 (such as the rotation angles of the modulation molecules 421) can be controlled by the modulation-control signals, the modulation molecules 41 can alternately allow or block the microwave signals in the modulation material 40 transmitted to the second radiation-signal layer 71. Therefore, the transmission speed of the microwave signals in the modulation material 40 can be changed by adjusting the inclined angles of the modulation molecules 41, and thus the phase of the microwave signals can be changed.

The microwave device 1 includes support structures 80 connected to the radiator 30 and the radiator 70, and extending along the stacking direction D1. In other words, the support structure 80 is located between the substrate 32 and the substrate 72. The support structure 80 is configured to strengthen the structure of the microwave device 1, and maintain the distance between the radiator 30 and the radiator 70. The support structure 80 is disposed on the substrate 32, and is disposed under the substrate 72. In some embodiments, the support structure 80 is disposed on the first radiation-signal layer 33, and disposed under the second radiation-signal layer 71.

The microwave device 1 further includes at least one support structure 80*a* connected to the radiator 10 and the radiator 70. In other words, the support structure 80*a* is located between the radiator 10 and the radiator 70. In this embodiment, the support structure 80*a* is connected to the substrate 11 and the substrate 72. The support structure 80*a* is configured to strengthen the structure of the microwave device 1, and maintain the distance between the radiator 10 and the radiator 70.

The support structures 80 and 80*a* include insulation materials or conductive materials. In some embodiments, the support structures 80 and 80*a* includes copper, silver, gold, or alloys thereof. In some embodiments, the support structures 80 and 80*a* may include plastic or plastic-like materials. The plastic or plastic-like materials may be made by single material or composite materials, such as polyethylene terephthalate (PET), polyethylene (PE), polyethersulfone (PES), Polycarbonate (PC), polymethylmethacrylate (PMMA), or glass, but they are not limited thereto.

As shown in FIG. 1, the first radiation-signal layer 33 includes a first metal layer 331 and a first protective layer 332. The first metal layer 331 is disposed on the substrate 32, and extends parallel to the substrate 32. The first metal layer 331 may be configured to transmit microwave signals.

The materials of the first metal layer 331 may be low-resistance materials, such as copper, aluminum, silver, and gold, but it is not limited thereto. The thickness of the first metal layer 331 is in a range from about 2 um to 5 um. In this embodiment, the thickness of the first metal layer 331 is about 3 um. The thicknesses in the disclosure are measured in the stacking direction D1.

The first protective layer 332 is disposed on the first metal layer 331. The first protective layer 332 extends along the surfaces of the first metal layer 331 and the substrate 32. Moreover, the first protective layer 332 may be in contact with or cover a portion of the substrate 32 not covered by the first metal layer 331.

The first protective layer 332 is configured to protect the first metal layer 331. In this embodiment, the first protective layer 332 is configured to reduce or prevent oxidation or corrosion at the first metal layer 331 outside the sealing element 50, or to prevent the first metal layer 331 from connecting to the modulation material 40. In this embodiment, an alignment layer can cover the first protective layer 332 (not shown in figures), and the modulation material 40 is in contact with the alignment layer.

The opening S3 passes through the first metal layer 331 and the first protective layer 332 along the stacking direction D1. Therefore, the microwave signals enters into the modulation material 40 via the opening S3. In some embodiments, since the first protective layer 332 may be made of insulation materials, the opening S3 may not pass through the first protective layer 332 in the stacking direction D1.

The materials of the first protective layer 332 may be silicon nitride, silicon oxide, silicon oxynitride, aluminum oxide, or a combination thereof, but it is not limited thereto. The thickness of the first protective layer 332 is in a range from about 300 A to 1500 A. In this embodiment, the thickness of the first protective layer 332 is about 500 A. The thickness of the first metal layer 331 is 3 times to 30 times the thickness of the first protective layer 332. The thicknesses of the disclosure are measured in the stacking direction D1.

As shown in FIG. 1, the second radiation-signal layer 71 includes a second metal layer 711 and a second protective layer 712. The second metal layer 711 is disposed on the substrate 72, and extends parallel to the substrate 72. In some embodiments, the second metal layer 711 includes electrodes 714. The electrodes 714 are configured to transmit the microwave signals and/or modulation-control signals. The number of the electrodes 714 corresponds to the number of the opening S3, but it is not limited thereto. In some embodiments, the number of the electrodes 714 is different from the number of the openings S3.

The materials of the second metal layer 711 may be low-resistance materials, such as copper, aluminum, silver, gold, but it is not limited thereto. The thickness of the second metal layer 711 is in a range from about 0.2 um to 3 um. In this embodiment, the thickness of the second metal layer 711 is about 0.6 um. The second protective layer 712 is disposed on the second metal layer 711. The second protective layer 712 extends along the surfaces of the second metal layer 711 and the substrate 72. Moreover, the second protective layer 712 may be in contact with or cover a portion of the substrate 72 not covered by the second metal layer 711.

The second protective layer 712 is configured to protect the second metal layer 711. In this embodiment, the second protective layer 712 is configured to reduce or prevent oxidation or corrosion at the second metal layer 711 outside the sealing element 50, or to prevent the second metal layer 711 from connecting to the modulation material 40. In this embodiment, an alignment layer can cover the second protective layer 712 (not shown in figures), and modulation material 40 is in contact with the alignment layer.

The materials of the second protective layer 712 may be silicon nitride, silicon oxide, silicon oxynitride, aluminum oxide, or a combination thereof, but it is not limited thereto. The thickness of the second protective layer 712 is in a range from about 300 A to 1500 A. In this embodiment, the thickness of the second protective layer 712 is about 500 A. The thickness of the second metal layer 711 is 1 time to 10 times the thickness of the second protective layer 712. The thickness of the second protective layer 712 is equal to or substantially equal to the thickness of the first protective layer 332.

The second radiation-signal layer 71 further includes support pads 713. The support pads 713 are located between the second protective layer 712 and the substrate 72, and/or in contact with the second protective layer 712. The support pads 713 are adjacent to the electrode 714. The support pads 713 and the electrode 714 may be located at a plane parallel to the reference plane R1.

In some embodiments, the spacing structure 60 is connected to the alignment layer located on the first protective layer 332 and the alignment layer located on the second protective layer 712. The support pads 713 are located on the spacing structure 60. The thickness of the support pads 713 may be equal to or substantially equal to the thickness of the electrode 714. In some embodiments, the materials the support pads 713 may be the same as the materials of the electrode 714. The support pads 713 and the electrode 714 may be simultaneously formed by the same manufacturing process. Therefore, the distance between the first radiation-signal layer 33 and the second radiation-signal layer 71 may be adjusted by the support pads 713.

In some embodiments, the second radiation-signal layer 71 excludes support pads 713. In other words, the distance between the substrate 32 and the substrate 72 can be maintained by elongating the length of the spacing structure 60.

Figure 6A:
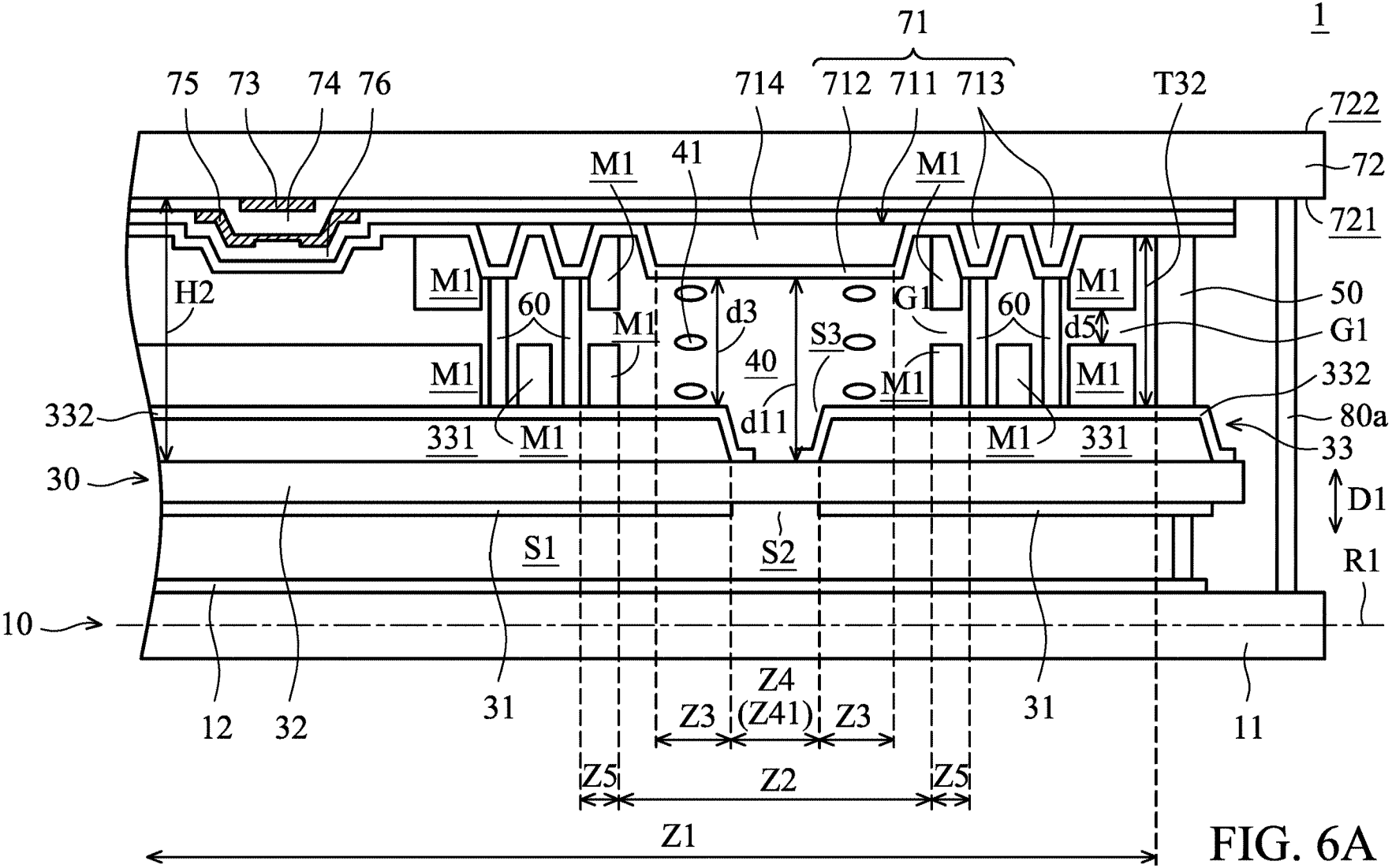
FIG. 6A is a schematic view of the microwave device in accordance with a fourth embodiment of the disclosure.
Figure 6B:
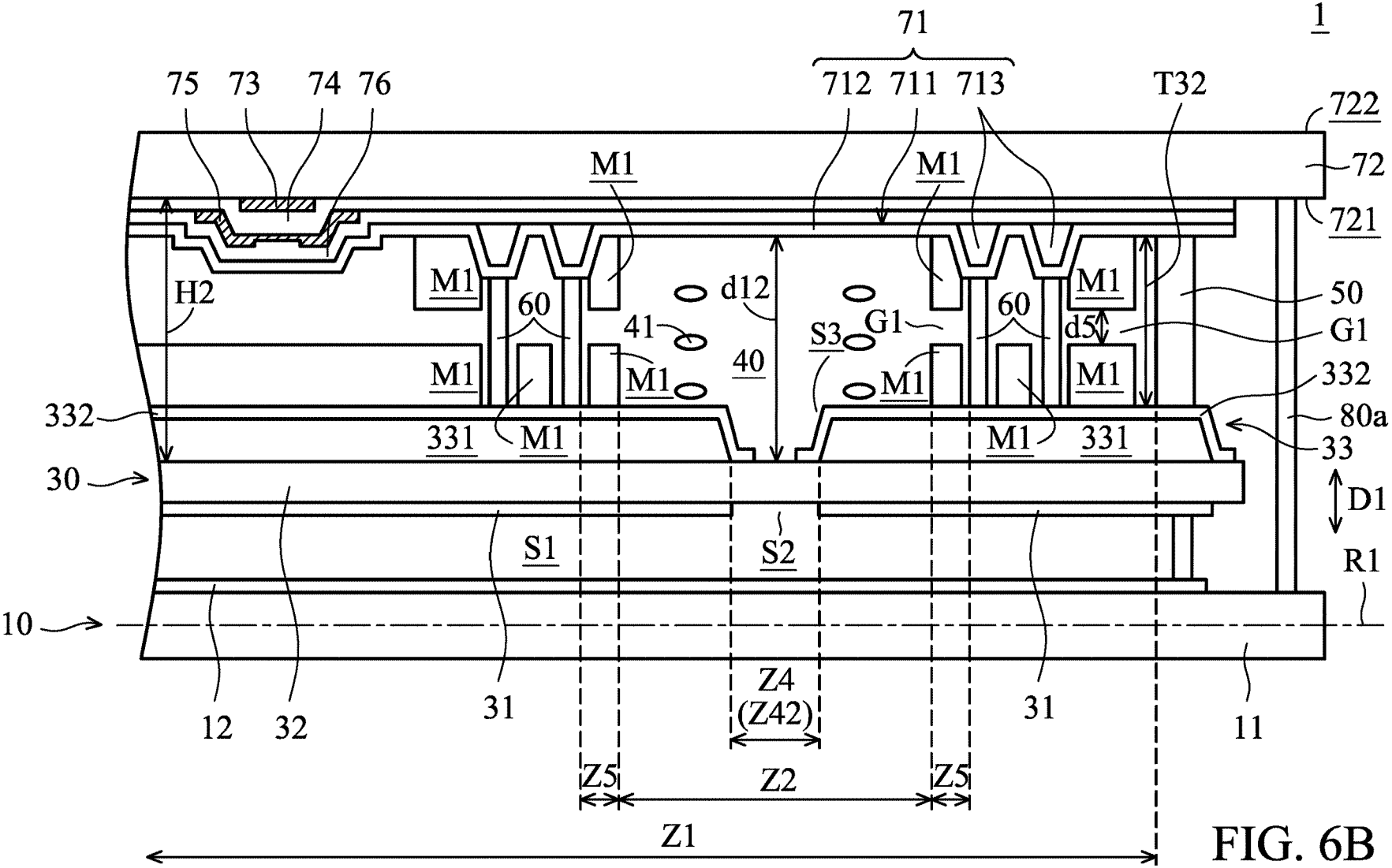
FIG. 6B is a schematic view of the microwave device in accordance with a fourth embodiment of the disclosure.

FIG. 2 is a schematic view of a microwave device 1 in accordance with a first embodiment of the disclosure. As shown in FIGS. 2, 6A and 6B, in this embodiment, an active zone Z1 is formed by a space between the sealing element 50, substrate 32, and substrate 72. The spacing structure 60 may be a columnar structure, and may be disposed in the active zone Z1. The active zone Z1 includes modulation zones Z3 and leaking zones Z4. The modulation zone Z3 is defined as the zone between the first metal layer 331 and the electrode 714 in the stacking direction D1, and in the modulation zone Z3, the first metal layer 331 overlapping with the electrode 714.

A modulation unit 90 is formed by the opening S3, the electrode 714 corresponding to the opening S3, the spacing structures 60 adjacent to the opening S3 and the electrode 714. In some embodiments, the microwave device 1 includes many modulation units. Each of the modulation unit 90 includes at least one modulation zone Z3. In this embodiment, each of the modulation unit 90 includes two modulation zones Z3.

The leaking zone Z4 is a zone over the opening S3 in the stacking direction D1. The microwave signals enter into the leaking zone Z4 via the opening S3. The leaking zone Z4 includes a first zone Z41 and a second zone Z42. The first zone Z41 is a zone between the opening S3 and the electrode 714 in the stacking direction D1. The second zone Z42 is a zone between the opening S3 and an area excluding the electrode 714 in the stacking direction D1. In the stacking direction D1, a first projection area of the electrode 714 and the opening S3 corresponding to the electrode 714 is formed on the first substrate 32. An edge of the first projection area expending a width W formed a prohibited-zone edge E1.

The width W is in a range from X to Y, wherein the X is a spacing distance (such as the d3 in FIG. 6A) of the modulation zone Z3. The Y is 0.01 times the wavelength in vacuum (the wavelength in vacuum is variable according to an operating frequency). The prohibited-zone edge E1 defines a prohibited zone Z2. In the disclosure, the fill material can be disposed in the active zone Z1, and thus the quantity of expensive modulation material 40 can be reduced. The fill material may include the spacing structures 60 and the protrusions M1. In the disclosure, the protrusions M1 are disposed in the active zone Z1, but the protrusions M1 are separated from the prohibited zone Z2. In other words, the protrusions M1 are not disposed in the prohibited zone Z2.

Figure 3:
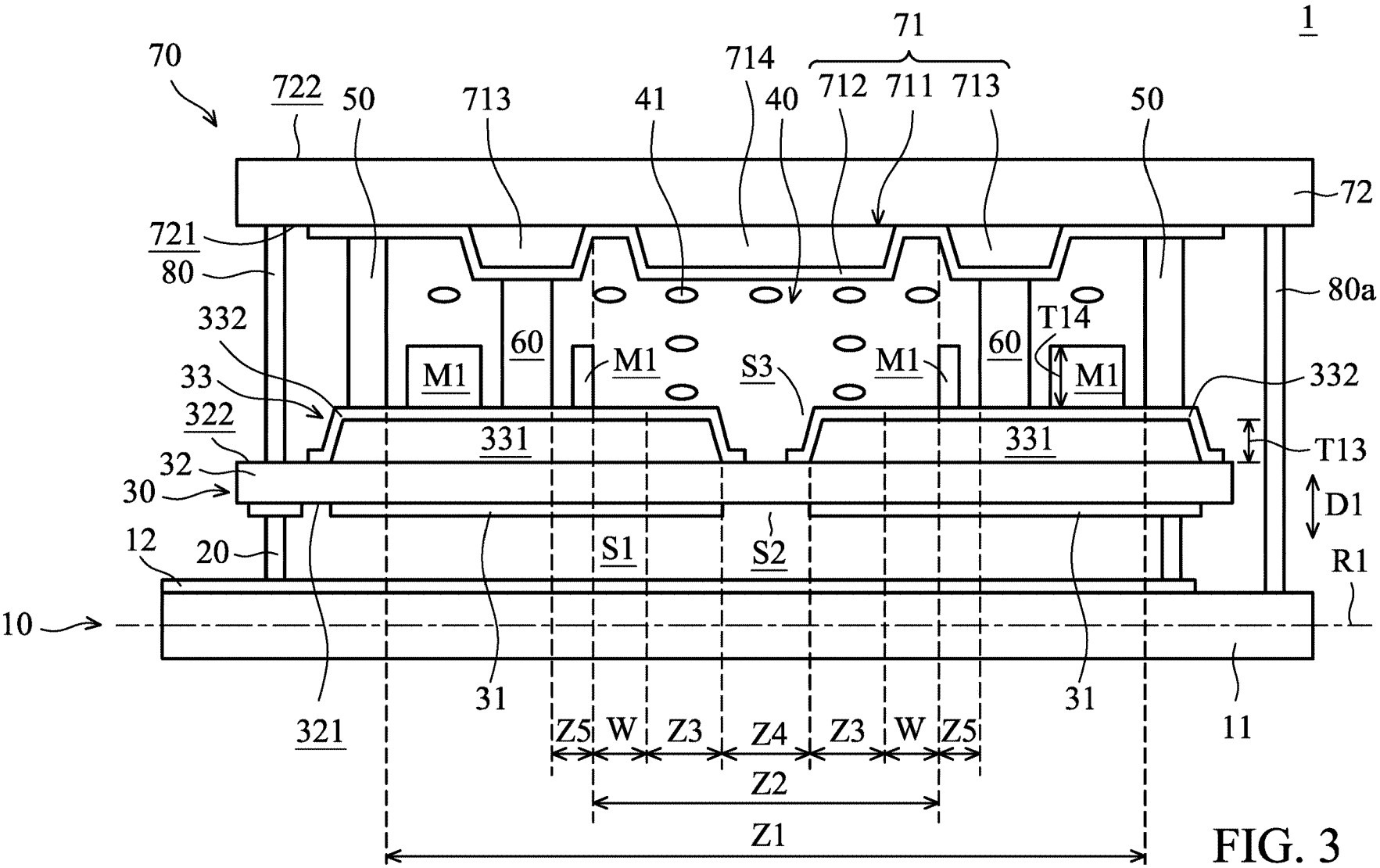
FIG. 3 is a cross-sectional view of the section BB' in FIG. 4.
Figure 4:
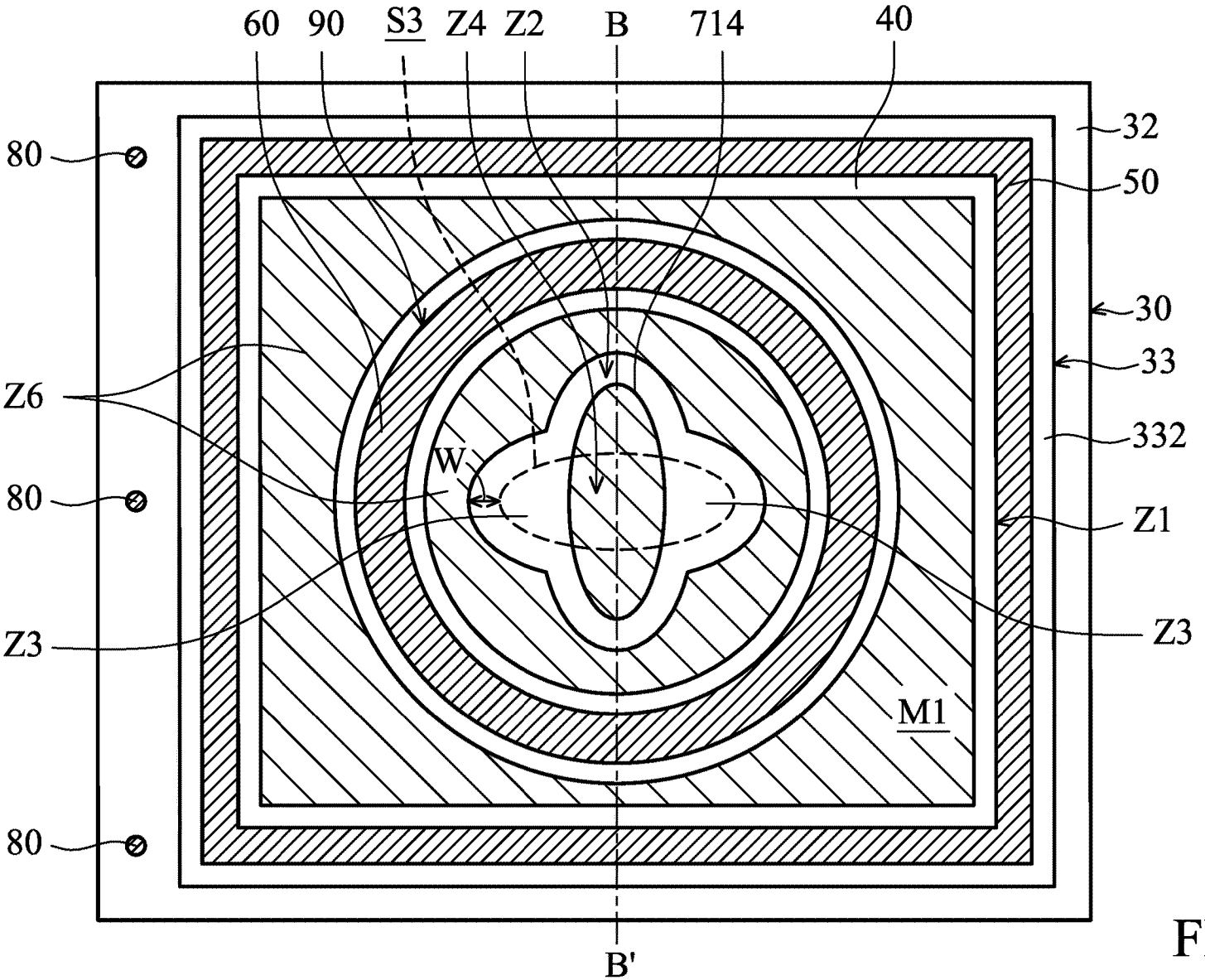
FIG. 4 is a schematic view of the microwave device in accordance with a second embodiment of the disclosure.

FIG. 3 is a cross-sectional view of the section BB' in FIG. 4. FIG. 4 is a schematic view of the microwave device 1 in accordance with a second embodiment of the disclosure. In the disclosure, the protrusions M1 are disposed in the active zone Z1 thus the quantity of expensive modulation material 40 can be reduced, and the manufacturing cost of the microwave device 1 can be reduced. In this embodiment, the protrusions M1 are solid, and the modulation material 40 is liquid, such as liquid crystal, and the protrusions M1 are in contact with the modulation material 40 or the alignment layer (not shown in figures) on the first protective layer 332, or both the modulation material 40 and the alignment layer (not shown in figures) on the first protective layer 332.

The protrusions M1 may be disposed in a space formed by the sealing element 50, the substrate 32, and the substrate 72. The protrusion M1 may be connected to radiator 30 and/or radiator 70. In this embodiment, the protrusion M1 is connected to the radiator 30 (substrate 32, or the layer on the substrate 32, such as the first metal layer 331, the first protective layer 332, the alignment layer, which is not shown in figures, on the first protective layer 332). The protrusion M1 may be separated from the radiator 70. In this embodiment, the protrusions M1 are in contact with the alignment layer on the first protective layer 332 and/or the modulation material 40.

In this embodiment, in a direction perpendicular to the stacking direction D1, the protrusion M1 is separated from the spacing structure 60. In other words, the protrusion M1 is adjacent to the spacing structure 60, and does not contact with the spacing structure 60. In some embodiments, the protrusions M1 is in contact with spacing structure 60. In this embodiment, in a direction perpendicular to the stacking direction D1, the protrusion M1 is separated from the sealing element 50. In some embodiments, the protrusion M1 is in contact with the sealing element 50.

In the active zone Z1, a non-work zone Z6 is a zone excluding the modulation zone Z3, the leaking zone Z4 and the spacing structure 60. In some embodiments, in the non-work zone Z6, the greatest thickness T14 of the protrusions M1 is about 0.5 times to 100 times the greatest thickness T13 of the first metal layer 331, and less than the thickness of the sealing element 50. The greatest thicknesses T13 and T14 are measured along the stacking direction D1.

In some embodiments, the materials of the protrusions M1 may be a single or composite organic materials, such as polyfluoroalkoxy (PFA), glass glue, polyethylene terephthalate (PET), polyimide (PI), polyethersulfone (PES), Mylar, polyethylene (PE), polycarbonate (PC), acrylic or polymethylmethacrylate (PMMA) but it is not limited thereto. The protrusions M1 may be made of a conductive material, such as metal. In some embodiments, the materials of the protrusions M1 and the spacing structures 60 are the same.

In some embodiments, when the material of the protrusion M1 is SiOx, SiNx, or SiON, the protrusion M1 has the effect of reducing the amount of warpage of the substrate 32 or the substrate 72.

Figure 5:
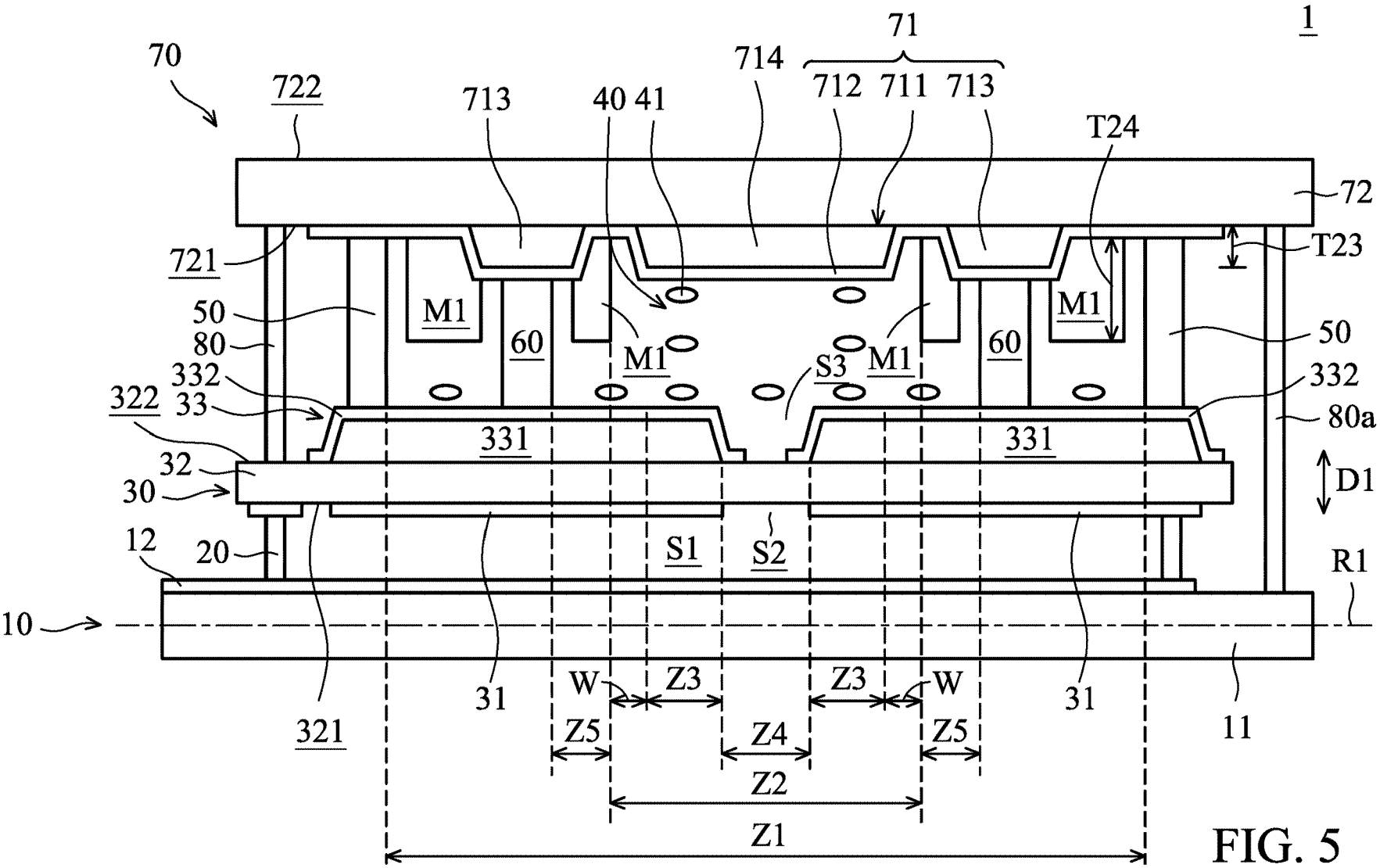
FIG. 5 is a schematic view of the microwave device in accordance with a third embodiment of the disclosure.

FIG. 5 is a schematic view of the microwave device 1 in accordance with a third embodiment of the disclosure. In this embodiment, the protrusions M1 are connected to the radiator 70 (the substrate 72 or the layers on the substrate 72, such as the second metal layer 711, the second protective layer 712, or the alignment layer on the second protective layer 712, which is not shown in figures). The protrusions M1 may be separated from the radiator 30. In this embodiment, the protrusions M1 are in contact with the alignment layer on the second protective layer 712 (not shown in figures), or are in contact with the modulation material 40.

In some embodiments, in the non-work zone Z6, the greatest thickness T24 of the protrusions M1 is about 0.5 times to 200 times the greatest thickness T23 of the second metal layer 711. The greatest thicknesses T23 and T24 are measured in the stacking direction D1.

FIG. 6A is a schematic view of the microwave device 1 in accordance with a fourth embodiment of the disclosure. FIG. 6B is a schematic view of the microwave device 1 in accordance with a fourth embodiment of the disclosure. The locations of the sections of FIG. 6A and FIG. 6B are illustrated according to section AA' and section BB' in FIG. 2. In this embodiment, the protrusions M1 are simultaneously in contact with radiator 30 and radiator 70 (substrate 72 and substrate 32, or the layers on substrate 72 and substrate 32, such as the first metal layer 331, the second metal layer 711, the first protective layer 332, the second protective layer 712, and two of the alignment layers on the first protective layer 332 and the second protective layer 712, but it is not limited thereto). In this embodiment, the protrusions M1 include a gap G1 separating radiator 30 from radiator 70. In some embodiments, the protrusions M1 exclude the gap G1.

Figure 7:
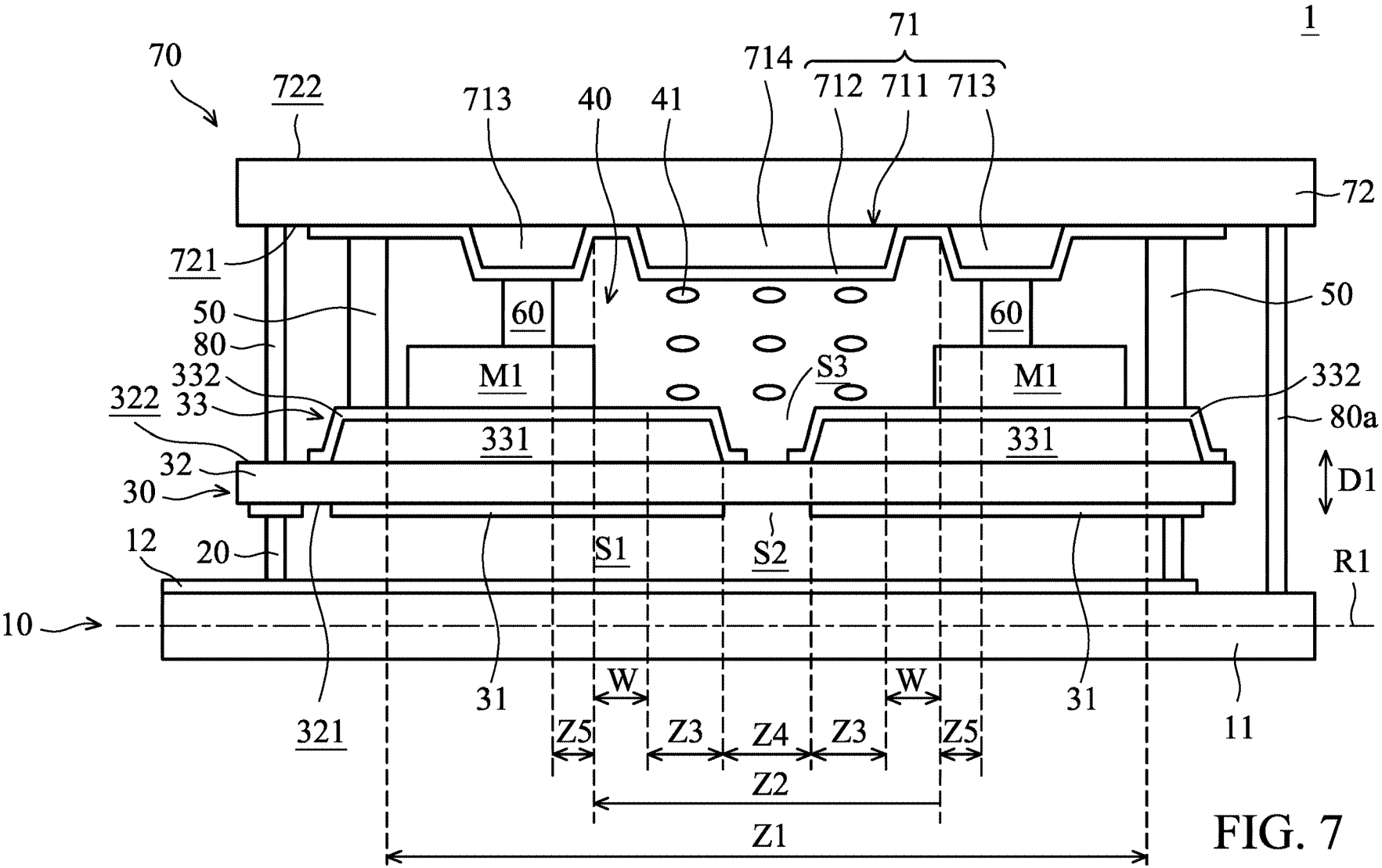
FIG. 7 is a schematic view of the microwave device in accordance with the fifth embodiment of the disclosure.

FIG. 7 is a schematic view of the microwave device 1 in accordance with the fifth embodiment of the disclosure. In this embodiment, the protrusions M1 are in contact with the radiator 30, and separated from the radiator 70. The protrusions M1 are in contact with the alignment layer on the first protective layer 332 (not shown in figures) or the modulation material 40. In the stacking direction D1, the spacing structure 60 is located between the protrusion M1 and the substrate 72.

In some embodiments, in the stacking direction D1, the spacing structure 60 is located between the protrusion M1 and the substrate 32.

In this embodiment, when the materials of the protrusions M1 and the first protective layer 332 are the same, the protrusion M1 and the first protective layer 332 can be formed as a single piece.

Figure 8:
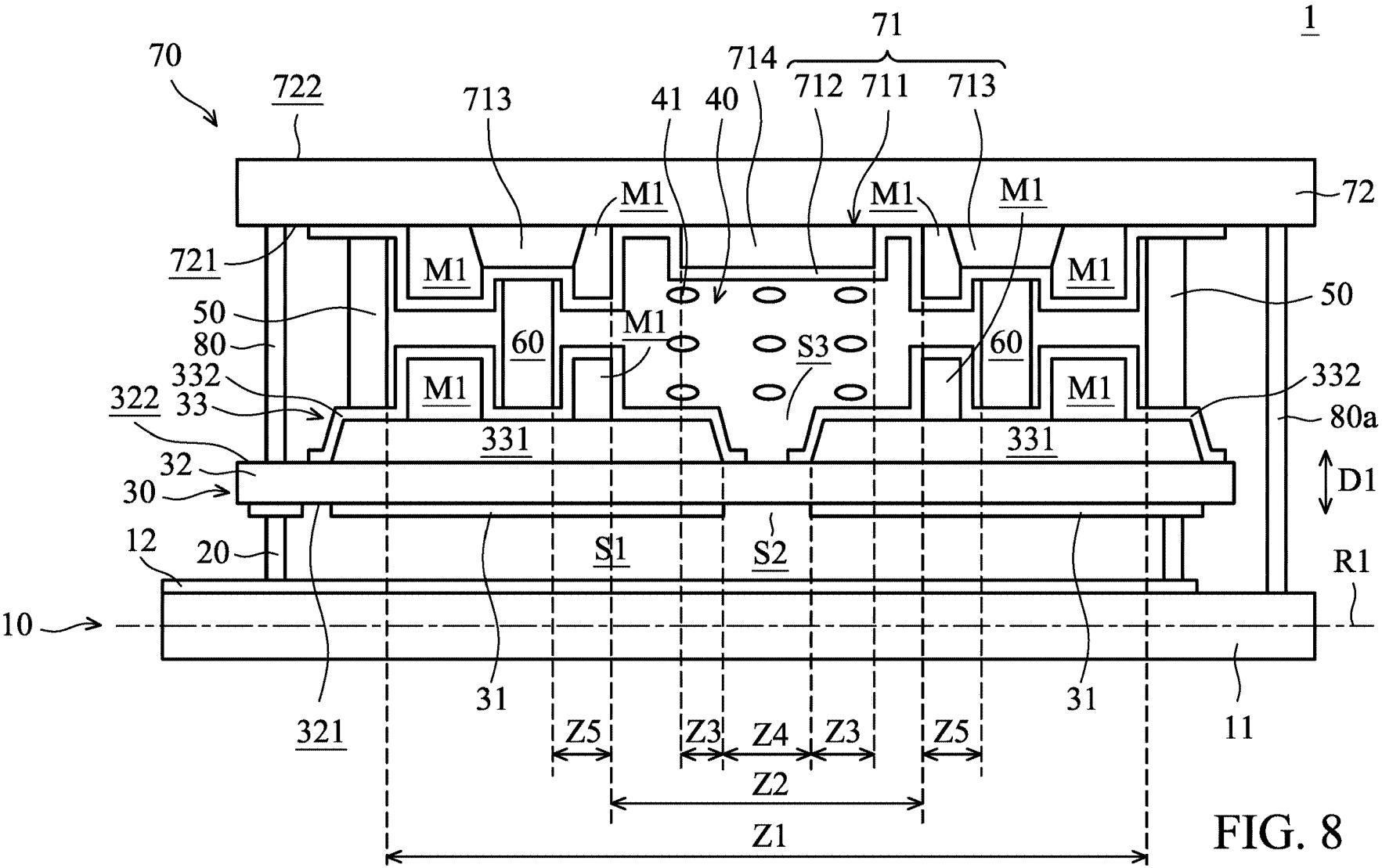
FIG. 8 is a schematic view of the microwave device in accordance with the sixth embodiment of the disclosure.

FIG. 8 is a schematic view of the microwave device 1 in accordance with the sixth embodiment of the disclosure. In this embodiment, the first protective layer 332 covers the protrusions M1. In the stacking direction D1, the protrusions M1 are located between the first protective layer 332 and the first metal layer 331. In this embodiment, when the materials of the protrusions M1 and the first protective layer 332 are the same, the protrusion M1 and the first protective layer 332 can be formed as a single piece.

In this embodiment, the second protective layer 712 may cover the protrusions M1. In the stacking direction D1, the protrusions M1 are located between the second protective layer 712 and the substrate 72. In this embodiment, when the materials of the protrusions M1 and the second protective layer 712 are the same, the protrusions M1 and the second protective layer 712 can be formed as a single piece.

Figure 9:
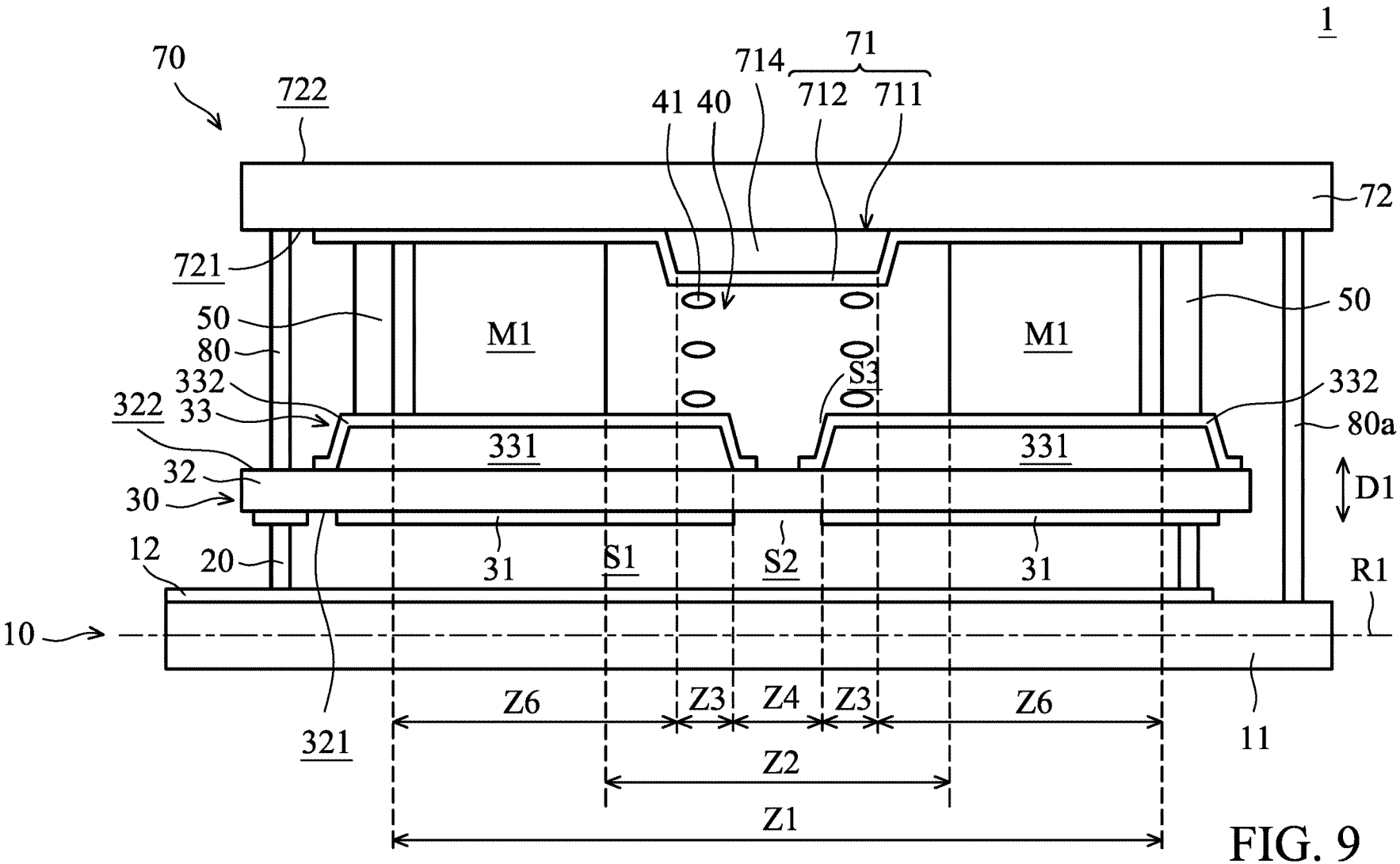
FIG. 9 is a schematic view of the microwave device in accordance with the seventh embodiment of the disclosure.

FIG. 9 is a schematic view of the microwave device 1 in accordance with the seventh embodiment of the disclosure. In this embodiment, the microwave device 1 may exclude the spacing structure 60 and the support pad 713. In some embodiments, the microwave device 1 may include the support pad 713.

In the stacking direction D1, the protrusions M1 are located between the substrate 32 and the substrate 72. In this embodiment, in the stacking direction D1, the protrusions M1 are located between the first protective layer 332 and the second protective layer 712, and are in contact with the alignment layer on the first protective layer 332 (not shown in figures) or the alignment layer on the second protective layer 712 (not shown in figures). The protrusions M1 may be filled in a zone between radiator 30 and radiator 70 outside of the prohibited zone Z2.

Figure 10:
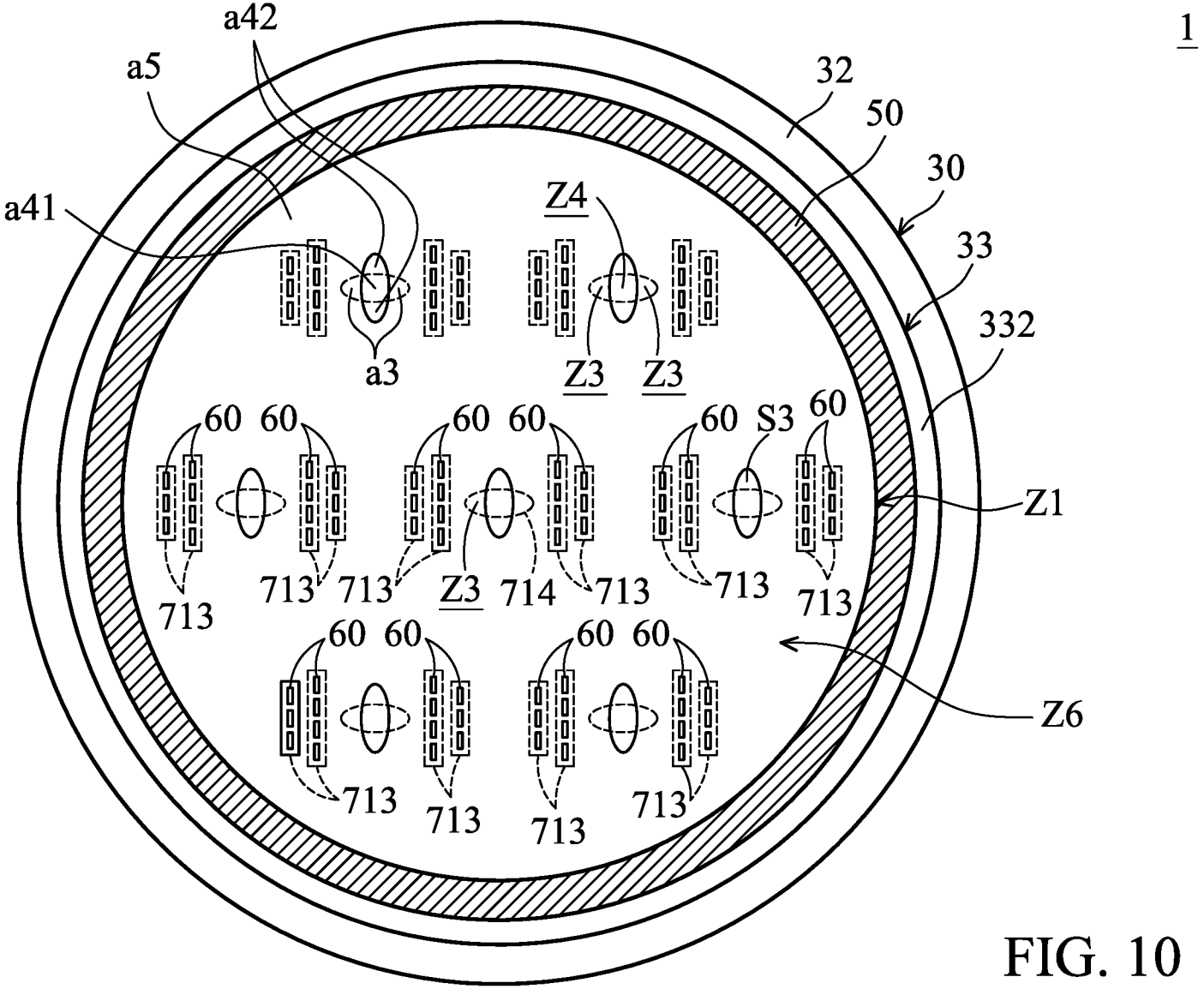
FIG. 10 is a schematic view of the microwave device in accordance with the eighth embodiment of the disclosure.

FIG. 10 is a schematic view of the microwave device 1 in accordance with the eighth embodiment of the disclosure. In this embodiment, there are seven modulation units illustrated. The seven modulation units correspond to seven electrodes 714 and seven openings S3. In the cross sections of each of the modulation units as shown in FIGS. 6A and 6B, each of the modulation units includes at least one modulation zone Z3 and one leaking zone Z4. The modulation zone Z3 is a zone between the first metal layer 331 and the electrode 714 in the stacking direction D1. The leaking zone Z4 is a zone corresponding to the opening S3 in the stacking direction D1. The microwave signals may enter into the modulation material 40 via the opening S3.

The leaking zone Z4 includes a first zone Z41 and a second zone Z42. The first zone Z41 is a zone between the opening S3 and the electrode 714 in the stacking direction D1. The second zone Z42 is a zone of the leaking zone Z4 excluding the first zone z41. The substrate 32 may be circle or polygon. The spacing structure 60 is disposed in the active zone Z1 between the sealing element 50, the substrate 32, and the substrate 72. The spacing structures 60 are disposed adjacent to the electrode 714 corresponding thereto. At least portions of the electrode 714 and the opening S3 are overlapped in the stacking direction D1.

In the active zone Z1, a non-work zone Z6 is a zone excluding the modulation zone Z3, the leaking zone Z4 and the spacing structure 60. The non-work zone Z6 may include a fill zone Z5 located between the prohibited zone Z2 and the adjacent spacing structure 60 (as shown in FIG. 6A).

In this embodiment, according to the described embodiments, the protrusions M1 may be disposed in a zone that is outside of the prohibited zone Z2, such as non-work zone Z6 or fill zone Z5. It should be noted that, in the top view of this embodiment, an extension direction of the length of the spacing structures 60 schematically extend perpendicular to an extension direction of the length of the electrode 714. However, the extension direction of the length of the spacing structures 60 and the extension direction of the length of the electrode 714 may extend in the same direction, or the spacing structures 60 are inclined relative to the electrode 714.

The disclosed features may be combined, modified, or replaced in any suitable manner in one or more disclosed embodiments, but are not limited to any particular embodiments. For example, in the second embodiment of FIG. 3, the protrusion M1 can be in contact with the radiator 70. In the third embodiment of FIG. 5, the protrusion M1 can be in contact with the radiator 30.

In described embodiments of the disclosure, the use of the modulation material 40 can be reduced due to the fill material. In some embodiments, a ratio of the projection area of the fill material on the first surface 322 in the stacking direction D1 to the projection area of the active zone Z1 on the first surface 322 is in a range from about 0.02 to 0.83.

In described embodiments of the disclosure, the use of the modulation material 40 can be reduced since the protrusion M1 (fill material) is disposed in the active zone Z1 outside of the prohibited zone Z2. The ratio of the volume of the modulation material 40 to the volume of the active zone Z1 is in a range from 0.14 to 0.98. The ratio can be calculated by the volume of the modulation material 40/(A*d3). The ratio can be calculated by the formula: (a41*d11+a42*d12+a3*d3+a5*d5)/(A*d3).

As shown in FIG. 10, the a41 is the projection area of the first zone Z41 of the leaking zone Z4 on the first surface 322. The a42 is projection area of the second zone Z42 of the leaking zone Z4 on the first surface 322. The a3 is the projection area of the modulation zone z3 on the first surface 322. The A is the projection area of the active zone Z1 on the first surface 322. The a5 is the projection area of the non-work zone z6 on the first surface 322. The a5 can be calculated by the formula that (A-a41-a42-a3-the projection area of spacing structure 60 on the first surface 322).

As shown in FIGS. 6A and 6B, the spacing distance d11 is a greatest distance of the first zone Z41 of the leaking zone Z4 in the stacking direction D1. In other words, the spacing distance d11 is equal to a height of the modulation material 40 in the first zone Z41 of the leaking zone Z4. The spacing distance d12 is a greatest distance of the second zone Z42 of the leaking zone Z4 in the stacking direction D1. In other words, the spacing distance d12 is equal to the height of the modulation material 40 in the second zone Z42. The spacing distance d3 is a distance of the modulation zone z3 in the stacking direction D1. In other words, the spacing distance d3 is equal to the height of the modulation material 40 in the modulation zone Z3. The spacing distance d5 is the shortest distance of the non-work zone z6 in the stacking direction D1 (as shown in FIG. 2). In other words, the spacing distance d5 is equal to the shortest height of the modulation material 40 in the non-work zone z6. The unit of the spacing distances d11, d12, d3 and d5 is μm (micrometer), and the unit of the projection areas A, a41, a42, a3 and a5 is square micrometers.

In described embodiments of the disclosure, the fill material is disposed in the active zone Z1 outside of the prohibited zone Z2, and thus the quantity of expensive modulation material 40 can be reduced. As shown in FIG. 6A, the microwave device 1 further includes the first circuit layer 73, the second circuit layer 75, the first insulation layer 74 and the second insulation layer 76. The first circuit layer 73 is disposed on the substrate 72, and the first insulation layer 74 is disposed between the first circuit layer 73 and the second circuit layer 75. The second insulation layer 76 is disposed between the second protective layer 712 and the first insulation layer 74. The second protective layer 712 is disposed between the modulation material 40 and the second insulation layer 76.

The thickness of the protrusion M1 is greater than the total thickness of the second protective layer 712, the first insulation layer 74 and the second insulation layer 76. Preferably, the thickness of the protrusion M1 is greater than 0.3 μm, and less than the thickness of the sealing element 50.

In some embodiments, since the quantity of the modulation material 40 can be reduced due to the fill material, the volume of the fill material divided by (A*d3) is in a range from 0.02 to 0.86. The A is a projection area of the active zone Z1 on the substrate 32. The spacing distance d3 is equal to the height of the modulation zone Z3.

In described embodiments of the disclosure, the quantity of the modulation material 40 can be reduced since the protrusion M1 can be disposed in the active zone Z1 outside of the prohibited zone Z2 of the modulation unit.

In described embodiments of the disclosure, as shown in FIGS. 6A and 6B, the shortest spacing distance d5 in the non-work zone Z6 can be designed as the following formula:

$$0 < d5 < \left\{d3 - \frac{a41}{a5}(d11 - d3) - \frac{a42}{a5}(d12 - d3)\right\}$$

It should be noted that it is not necessary to dispose the protrusions M1 on both sides of the modulation material 40 in the non-work zone Z6. As long as the protrusions M1 are disposed on substrate 32 and/or substrate 72. When the protrusion M1 is only disposed on the substrate 32, the spacing distance d5 in the non-work zone Z6 is equal to the shortest distance between the protrusion M1 and the second protective layer 712 of the radiator 70. Similarly, when the protrusion M1 is only disposed on the substrate 72, the spacing distance d5 in the non-work zone Z6 is equal to the shortest distance between the protrusion M1 and the first protective layer 332 of the radiator 30. In other embodiments of the disclosure, a spacing distance (such as the spacing distance d5 in the non-work zone Z6) outside the modulation zone Z3 greater than zero and less than the spacing distance d3 in the modulation zone Z3.

In conclusion, the disclosure utilizes the fill material filled in the active zone, and thus the quantity of expensive modulation material 40 can be reduced, and the manufacturing cost of the microwave device 1 can be reduced.

While the disclosure has been described by way of example and in terms of preferred embodiment, it should be understood that the disclosure is not limited thereto. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A microwave device, comprising:

a first substrate having a first surface;

a first metal layer disposed on the first surface, wherein the first metal layer has a plurality of openings;

a second substrate having a second surface opposite to the first substrate, wherein the second surface is adjacent to the first surface;

a second metal layer disposed on the second surface, wherein the second metal layer comprises a plurality of electrodes, and the electrodes correspond to the openings;

a sealing element located between the first substrate and the second substrate, wherein an active zone is formed by a space between the sealing element, the first substrate, and the second substrate; and a modulation material filled in the active zone; and at least one fill material disposed in the active zone, wherein the fill material has a thickness that is greater than 0.3 μm and less than a height of the sealing element, and a ratio of a projection area of the fill material on the first surface to a projection area of the active zone on the first surface is in a range from 0.02 to 0.83.

2. The microwave device as claimed in claim 1, further comprising:

a first protective layer and a first alignment layer disposed on the first metal layer in sequence;

a second protective layer and a second alignment layer disposed on the second metal layer in sequence, wherein the fill material is connected to at least one of the first alignment layer and the second alignment layer.

3. The microwave device as claimed in claim 1, further comprising a first protective layer disposed on the first metal layer, and a second protective layer disposed on the second metal layer, wherein a portion of the fill material is disposed between the first protective layer and the first metal layer, or between the second protective layer and the second metal layer.

4. The microwave device as claimed in claim 1, wherein the fill material comprises silicon nitride, a single material, composite organic materials, glass glue, polyethylene terephthalate, polyimide, polyethersulfone, Mylar, polyethylene, polycarbonate, acrylic, polymethylmethacrylate, or a combination thereof.

5. The microwave device as claimed in claim 1, further comprising:

a first circuit layer disposed on the second surface;

a second circuit layer disposed on the first circuit layer;

a first insulation layer disposed between the first circuit layer and the second circuit layer;

a second protective layer disposed on the first insulation layer; and a second insulation layer disposed between the second protective layer and the first insulation layer, wherein a thickness of the fill material is greater than a total thickness of the second protective layer, the first insulation layer and the second insulation layer.

6. The microwave device as claimed in claim 1, wherein the active zone comprises:

a plurality of modulation zones between the electrodes and the first metal layer in a stacking direction;

a plurality of leaking zones corresponding to the openings in a stacking direction, wherein each of the leaking zones has a first zone and at least one second zone, the first zone is between one of the openings and one of the electrodes, which corresponds to the one of the openings, in the stacking direction, and the second zone is between the one of the openings and the one of the electrodes in the stacking direction excluding the first zone; and a non-work zone as a zone of the active zone excluding the modulation zones, the leaking zones, and a plurality of spacing structures;

wherein the fill material comprises the spacing structures and a plurality of protrusions disposed in the active zone and between the first substrate and the second substrate, wherein the protrusions are disposed in the non-work zone, and a shortest spacing distance d5 of the non-work zone complies with a formula:

$$0 < d5 < \left\{d3 - \frac{a41}{a5}(d11 - d3) - \frac{a42}{a5}(d12 - d3)\right\}$$

wherein the a41 is a projection area of the first zones on the first surface, the a42 is a projection area of the second zones on the first surface, the a3 is a projection area of the modulation zones on the first surface, the a5 is a projection area of the non-work zone on the first surface, the d11 is a spacing distance of the first zones, the d12 is a spacing distance of the second zones, the d3 is the spacing distance of the modulation zones.

7. The microwave device as claimed in claim 1, further comprising a support structure between the first substrate and the second substrate.

8. The microwave device as claimed in claim 1, further comprising a third substrate disposed under the first substrate, and a microwave-transmission layer is between the first substrate and the third substrate.

9. A microwave device, comprising:

a first substrate having a first surface;

a first metal layer disposed on the first surface and having a plurality of openings;

a second substrate having a second surface corresponding to the first substrate, wherein the second surface is adjacent to the first surface;

a second metal layer disposed on the second surface, wherein the second metal layer comprises a plurality of electrodes corresponding to the openings, and at least one modulation zone is between the electrodes and the first metal layer in a stacking direction, and the modulation zone has a first spacing distance d;

a sealing element located between the first substrate and the second substrate, wherein an active zone is formed by a space between the sealing element, the first substrate, and the second substrate;

a modulation material filled in the active zone; and at least one fill material disposed in the active zone, a thickness of the fill material is greater than 0.3 μm and less than a height of the sealing element, wherein the active zone on the first surface has a projection area of A, and a volume of the fill material divided by (A*d) is in a range from 0.02 to 0.86.

10. The microwave device as claimed in claim 9, wherein the fill material is disposed outside of the modulation zone, wherein a second spacing distance outside of the modulation zone and corresponding to the fill material is greater than zero and less than the first spacing distance.

11. The microwave device as claimed in claim 9, further comprising a first protective layer and a first alignment layer disposed on the first metal layer in sequence, and a second protective layer and a second alignment layer disposed on the second metal layer in sequence, wherein the fill material is connected to at least one of the first alignment layer and the second alignment layer.

12. The microwave device as claimed in claim 9, further comprising a first protective layer disposed on the first metal layer, and a second protective layer disposed on the second metal layer, wherein the fill material is disposed between the first protective layer and the first metal layer, or between the second protective layer and the second metal layer.

13. The microwave device as claimed in claim 9, wherein the fill material comprises silicon nitride, a single organic material, composite organic materials, glass glue, polyethylene terephthalate, polyimide, polyethersulfone, Mylar, polyethylene, polycarbonate, acrylic, polymethylmethacrylate, or a combination thereof.

14. The microwave device as claimed in claim 9, further comprising:

a first circuit layer disposed on the second surface;

a second circuit layer disposed on the first circuit layer;

a first insulation layer disposed between the first circuit layer and the second circuit layer;

a second protective layer disposed on the first insulation layers;

a second insulation layer disposed between the second protective layer and the first insulation layer, wherein a thickness of the fill material is greater than a total thickness of the second protective layer, the first insulation layer, and the second insulation layer.

15. The microwave device as claimed in claim 9, further comprising a support structure between the first substrate and the second substrate.

16. The microwave device as claimed in claim 9, further comprising a third substrate, the first substrate disposed between the second substrate and the third substrate, wherein a microwave-transmission layer is between the first substrate and the third substrate.

17. A microwave device, comprising:

a first substrate having a first surface;

a first metal layer disposed on the first surface and having a plurality of openings;

a second substrate having a second surface corresponding to the first substrate, wherein the second surface is adjacent to the first surface;

a second metal layer disposed on the second surface, wherein the second metal layer comprises a plurality of electrodes corresponding to the openings, and a modulation zone is between the electrodes and the first metal layer in a stacking direction;

a sealing element located between the first substrate and the second substrate, wherein an active zone is formed by a space between the sealing element, the first substrate, and the second substrate;

a modulation material filled in the active zone; and a fill material disposed between the first substrate and the second substrate;

wherein the active zone has a projection area A on the first surface, the modulation zone has a spacing distance d, and a volume of the modulation material divided by (A*d) is in a range from 0.14 to 0.98.

18. The microwave device as claimed in claim 17, wherein a ratio of a projection area of the fill material on the first substrate to the projection area of the active zone on the first surface is in a range from 0.02 to 0.83.

19. The microwave device as claimed in claim 17, further comprising:

a first circuit layer disposed on the second surface;

a second circuit layer disposed on the first circuit layer;

a first insulation layer disposed between the first circuit layer and the second circuit layer;

a second protective layer disposed on the first insulation layer;

a second insulation layer disposed between the second protective layer and the first insulation layer, wherein a thickness of the fill material is greater than a total thickness of the second protective layer, the first insulation layer and the second insulation layer, and less than a height of the sealing element.

20. The microwave device as claimed in claim 17, further comprising a third substrate, the first substrate disposed between the second substrate and the third substrate, wherein a microwave-transmission layer is between the first substrate and the third substrate.

* * * * *